US009625204B2

(12) United States Patent
Kim et al.

(10) Patent No.: US 9,625,204 B2
(45) **Date of Patent: *Apr. 18, 2017**

(54) REFRIGERATOR

(71) Applicant: LG Electronics Inc., Seoul (KR)

(72) Inventors: Minsub Kim, Seoul (KR); Kyukwan Choi, Seoul (KR); Kyusuh Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/081,193

(22) Filed: Mar. 25, 2016

(65) Prior Publication Data

US 2016/0209103 A1 Jul. 21, 2016

Related U.S. Application Data

(63) Continuation of application No. 14/603,445, filed on Jan. 23, 2015, now Pat. No. 9,322,592.

(30) Foreign Application Priority Data

Feb. 28, 2014 (KR) ..... 10-2014-0024252

(51) Int. Cl.
*F25D 23/02* (2006.01)
*F25D 23/04* (2006.01)
(Continued)

(52) U.S. Cl.
CPC ..... *F25D 23/028* (2013.01); *F25D 23/02* (2013.01); *F25D 23/025* (2013.01); *F25D 23/04* (2013.01);
(Continued)

(58) Field of Classification Search
CPC ..... F25D 23/02; F25D 23/025; F25D 23/028; F25D 2323/02; F25D 2323/023;
(Continued)

(56) References Cited

U.S. PATENT DOCUMENTS 1,927,398 A 9/1933 Glasser
2,051,132 A 8/1936 Dart
(Continued)

FOREIGN PATENT DOCUMENTS

CN 102042740 5/2011
CN 102338525 2/2012
(Continued)

OTHER PUBLICATIONS

European Search Report dated Jul. 2, 2015 for Application No. 15154093.7, 8 pages.
(Continued)

*Primary Examiner* — Andrew Roersma
(74) *Attorney, Agent, or Firm* — Fish & Richardson P.C.

(57) ABSTRACT

A refrigerator is discussed. The refrigerator includes a cabinet that includes a storage compartment. The refrigerator further includes a first door hinged on a first edge of the cabinet and configured to open and close a first portion of the storage compartment. The refrigerator further includes a first basket assembly supported by a first hinge mounted at a first inner wall of the storage compartment. The refrigerator further includes a first locking device configured to selectively couple the first basket assembly to the first door. The refrigerator further includes a first release device configured to release the first locking device and accessible from a first inner surface of the door and a first outer surface of the door.

28 Claims, 18 Drawing Sheets

(51) Int. Cl.
*F25D 23/06* (2006.01)
*F25D 25/00* (2006.01)

(52) U.S. Cl.
CPC ..... *F25D 23/065* (2013.01); *F25D 25/00* (2013.01); *F25D 2323/024* (2013.01)

(58) Field of Classification Search
CPC .. F25D 2323/024; F25D 25/00; F25D 25/005; F25D 25/02; F25D 25/021; F25D 25/022; F25D 25/024; F25D 25/025; F25D 2325/00; F25D 2500/02
See application file for complete search history.

(56) References Cited

U.S. PATENT DOCUMENTS

| | | | | |
|---|---|---|---|---|
| 2,070,511 | A | 2/1937 | Clements | |
| 2,204,053 | A | 6/1940 | Dart | |
| 2,243,772 | A | 5/1941 | Peltier | |
| 3,220,558 | A | 11/1965 | Erik | |
| 4,514,021 | A | 4/1985 | Sundermeier | |
| 4,711,098 | A | 12/1987 | Kuwabara | |
| 7,651,182 | B2 | 1/2010 | Eveland | |
| 7,698,785 | B2 | 4/2010 | Bennett | |
| 2008/0276422 | A1 | 11/2008 | Beckmann | |
| 2009/0064463 | A1 | 3/2009 | Gomoll et al. | |
| 2009/0273264 | A1 | 11/2009 | Butler | |
| 2010/0101267 | A1* | 4/2010 | Jung | F25D 23/028 62/449 |
| 2010/0269293 | A1 | 10/2010 | Wisniewski | |
| 2010/0308705 | A1 | 12/2010 | Kwon | |
| 2011/0023528 | A1 | 2/2011 | Kwon | |
| 2011/0083465 | A1 | 4/2011 | Kim | |
| 2012/0018435 | A1 | 1/2012 | Kim | |
| 2012/0042684 | A1 | 2/2012 | Lee | |
| 2012/0043873 | A1 | 2/2012 | Jeon | |
| 2012/0062093 | A1 | 3/2012 | Lee | |
| 2012/0286638 | A1 | 11/2012 | Lee | |
| 2012/0286639 | A1 | 11/2012 | Lee | |
| 2013/0026900 | A1 | 1/2013 | Oh | |
| 2013/0033163 | A1 | 2/2013 | Kang | |
| 2013/0049562 | A1 | 2/2013 | Jung | |
| 2013/0147337 | A1 | 6/2013 | Lim | |
| 2013/0169138 | A1 | 7/2013 | Im | |
| 2013/0276474 | A1 | 10/2013 | Kim | |
| 2014/0232250 | A1 | 8/2014 | Kim | |
| 2014/0232251 | A1 | 8/2014 | Kim | |

FOREIGN PATENT DOCUMENTS

| | | | |
|---|---|---|---|
| CN | 202166255 | | 3/2012 |
| CN | 102472553 | | 5/2012 |
| CN | 103477170 | | 12/2013 |
| DE | 10 2010003831 | A1 | 10/2011 |
| EP | 2 314 965 | A1 | 4/2011 |
| EP | 2565565 | | 3/2013 |
| JP | S 50-084862 | U | 7/1975 |
| JP | S 53-126899 | U | 10/1978 |
| JP | 63-142682 | A | 6/1988 |
| JP | 06-066473 | A | 3/1994 |
| JP | 2001-108357 | A | 4/2001 |
| JP | 2011-069612 | A | 4/2011 |
| JP | 2013-148274 | A | 8/2013 |
| KR | 1999-0042339 | A | 6/1999 |
| KR | 20-0168373 | Y1 | 2/2000 |
| WO | WO 2012/143273 | A2 | 10/2012 |

OTHER PUBLICATIONS

Office Action issued in Chinese Application No. 201510079333.2 on Oct. 14, 2016, 44 pages (with English translation).
Office Action issued in European Application No. 15154093.7 on Dec. 22, 2016, 7 pages.

* cited by examiner

REFRIGERATOR

CROSS REFERENCE TO RELATED APPLICATION

This application is a continuation of U.S. application Ser. No. 14/603,445, filed Jan. 23, 2015, now allowed, which claims the benefit of a Korean Patent Application No. 10-2014-0024252, filed on Feb. 28, 2014, both of which are hereby incorporated by reference as if fully set forth herein.

FIELD

The present disclosure relates to a refrigerator and, more particularly, to a refrigerator including a door pivotably mounted at the outside of a cabinet and a basket assembly pivotably mounted at the inside of the cabinet wherein the door and the basket assembly are selectively coupled to each other.

BACKGROUND

In general, a refrigerator is an appliance that reduces the interior temperature thereof using cool air generated by a refrigeration cycle including a compressor, a condenser, an expansion valve, and an evaporator to store foods in a frozen state or in a refrigerated state.

A refrigerator generally includes a freezer compartment for storing foods or beverages in a frozen state and a refrigerator compartment for storing foods or beverages at low temperature.

A refrigerator may be classified as a top mount type refrigerator, in which a freezer compartment is disposed above a refrigerator compartment, a bottom freezer type refrigerator, in which a freezer compartment is disposed under a refrigerator compartment, or a side by side type refrigerator, in which a freezer compartment and a refrigerator compartment are partitioned by a partition wall such that the freezer compartment is disposed at the left side of the refrigerator and the refrigerator compartment is disposed at the right side of the refrigerator.

In recent years, the capacity of a refrigerator has been greatly increased. In addition, a door shelf or a receiving case is provided at the inside of a door so as to form a space for receiving stored goods, thereby efficiently utilizing a receiving space of the refrigerator.

SUMMARY

An innovative aspect of the subject matter described in this specification is to provide a refrigerator configured to have a structure in which a basket assembly is pivotably supported at an inside wall of a storage compartment such that no load is applied to a door and in which the basket assembly is selectively separated from or coupled to the door such that the basket assembly can be pivoted.

Another innovative aspect of the subject matter described in this specification may be implemented in a refrigerator that includes a cabinet that includes a storage compartment; a first door hinged on a first edge of the cabinet and configured to open and close a first portion of the storage compartment; a second door hinged on a second edge of the cabinet and configured to open and close a second portion of the storage compartment; a first basket assembly supported by a first hinge mounted at a first inner wall of the storage compartment; a second basket assembly supported by a second hinge mounted at a second inner wall of the storage compartment; a first locking device configured to selectively couple the first basket assembly to the first door; a second locking device configured to selectively couple the second basket assembly to the second door; a first release device configured to release the first locking device and accessible from a first inner surface of the door and a first outer surface of the door; and a second release device configured to release the second locking device and accessible from a second inner surface of the door and a second outer surface of the door.

These and other implementations can each optionally include one or more of the following features. The first hinge is a first multi-articulated hinge connected to the first inner wall of the storage compartment and the first basket assembly via a first plurality of links. The second hinge is a second multi-articulated hinge connected to the second inner wall of the storage compartment and the second basket assembly via a second plurality of links. The first basket assembly and the second basket assembly are configured to define a gap when the first basket assembly is located adjacent to the first inner wall of the storage compartment and the second basket assembly is located adjacent to the second inner wall of the storage compartment. The first basket assembly is configured to pivot and not interfere with the second basket assembly. The second basket assembly is configured to pivot and not interfere with the first basket assembly. The first basket assembly includes a first frame fastened to an end of the first multi-articulated hinge; and a first plurality of baskets mounted to the first frame. The second basket assembly includes a second frame fastened to an end of the second multi-articulated hinge; and a second plurality of baskets mounted to the second frame.

The first basket assembly further includes a first plurality of basket location parts mounted to the first frame and configured to support the first plurality of baskets from a bottom of each basket such that each basket is located on a first respective basket location part. The second basket assembly further includes a second plurality of basket location parts mounted to the second frame and configured to support the second plurality of baskets from a bottom of each basket such that each basket is located on a second respective basket location part. The first frame is made of a metal material and includes a first pair of vertical frame parts spaced apart from each other and parallel to each other; and three horizontal frame parts that each connect to the first pair of vertical frame parts. The second frame is made of the metal material and includes a second pair of vertical frame parts spaced apart from each other and parallel to each other; and three additional horizontal frame parts that each connect to the second pair of vertical frame parts. The first locking device includes a first slider vertically and slidably mounted at a lower part of the first door and configured to selectively engage with a lowermost basket location part of the first plurality of basket location parts and a first elastic member configured for pushing the first slider upward.

The second locking device includes a second slider vertically and slidably mounted at a lower part of the second door and configured to selectively engage with a lowermost basket location part of the second plurality of basket location parts and a second elastic member configured for pushing the second slider upward. The first release includes a first release lever pivotably mounted at a first handle groove located at a bottom of the first door and configured for pushing the first slider downward; and a first release button slidably mounted at a rear of the first door and configured for pushing the first slider downward. The second release includes a second release lever pivotably mounted at a second handle groove located at a bottom of the second door and configured for pushing the second slider downward; and a second release button slidably mounted at a rear of the second door and configured for pushing the second slider downward. The first slider comprises a first catching protrusion configured to be selectively inserted into a first catching groove located at a bottom of a first basket location part.

The second slider comprises a second catching protrusion configured to be selectively inserted into a second catching groove located at a bottom of a second basket location part. The first release lever includes a first pivoting shaft part pivotably mounted to the first handle groove, a first lever part extending from the first pivoting shaft part, and a first arm part extending from one end of the first pivoting shaft part and configured for pushing the first slider while the pivoting first shaft part is pivoted. The second release lever includes a second pivoting shaft part pivotably mounted to the second handle groove, a second lever part extending from the second pivoting shaft part, and a second arm part extending from one end of the second pivoting shaft part and configured for pushing the second slider while the pivoting second shaft part is pivoted.

The first door includes a first concave part located at a rear of the first door and configured to receive a portion of a front of the first basket assembly, when the first basket assembly is coupled to a rear of the first door, one side of the first basket assembly is located opposite of an inner side of the first concave part such that the a side the first basket assembly is a first predetermined distance from the inner side of the first concave part. The second door includes a second concave part located at a rear of the second door and configured to receive a portion of a front of the second basket assembly, and when the second basket assembly is coupled to a rear of the second door, one side of the second basket assembly is located opposite of an inner side of the second concave part such that the a side the second basket assembly is a second predetermined distance from the inner side of the second concave part.

When the first basket assembly is located in the storage compartment, a bottom of the first basket assembly is located opposite of a bottom of the storage compartment such that the bottom of the first basket assembly is a third predetermined distance from the bottom of the storage compartment. When the second basket assembly is located in the storage compartment, a bottom of the second basket assembly is located opposite of a bottom of the storage compartment such that the bottom of the second basket assembly is a fourth predetermined distance from the bottom of the storage compartment. The refrigerator further includes a first repulsion member located at a rear of the first door and configured to separate the first basket assembly from the first door when the first release device is operated; and a second repulsion member located at a rear of the second door and configured to separate the second basket assembly from the second door when the second release device is operated.

Another innovative aspect of the subject matter described in this specification may be implemented in a refrigerator that includes a cabinet; a storage compartment located in the cabinet; a door hinged on an edge of the cabinet and configured to open and close the storage compartment; a basket assembly supported by a multi-articulated hinge mounted at an inner wall of the storage compartment; a locking device configured to selectively couple the basket assembly and the door; and a release device configured to release the locking device and accessible from an inner surface and an outer surface of the door.

These and other implementations can each optionally include one or more of the following features. The basket assembly includes a frame fastened to an end of the multi-articulated hinge; and a plurality of baskets located on the frame. The locking device includes a slider vertically and slidably mounted at a lower part of the door; and an elastic member configured for pushing the slider upward. The release device includes a release lever pivotably mounted to a handle groove located at a bottom of the door and configured for pushing the slider downward; and a release button slidably mounted to a rear of the door and configured for pushing the slider downward. The slider comprises a catching protrusion configured to be selectively inserted into a catching groove located at a bottom of the basket assembly. The release button is located at a rear end of the door with an inclined surface, the inclined surface configured for pushing an inclined hole located at the slider to move the slider downward.

The release lever includes a pivoting shaft part pivotably mounted to the handle groove, a lever part extending from the pivoting shaft part, and an arm part extending from one end of the pivoting shaft part and configured for pushing the slider while the pivoting shaft part is pivoted. The lever part is located in the handle groove and adjacent to a pivoting shaft of the door. A moving track of a front of the basket assembly is configured to pivot while being supported by the multi-articulated hinge and coincide with a moving track of a rear of the door. The door is concave and configured to receive a portion of a front of the basket assembly when the door is coupled to the basket assembly. The refrigerator further includes a repulsion member located at a rear of the door and configured for separating the basket assembly from the door when the release device is operated. A width of the basket assembly is less than a width of an opening of a front of the storage compartment.

Another innovative aspect of the subject matter described in this specification may be implemented in a refrigerator that includes a cabinet that includes a storage compartment with an entrance; a door mounted by a first hinge mounted at an upper part of the cabinet and a second hinge mounted at a lower part of the cabinet and configured to open and close the storage compartment; a door storage space part that includes an additional storage space formed by a step surface depressed at an edge of an inner side of the door; a third hinge mounted at an upper part of an inner wall of the storage compartment and a fourth hinge mounted a lower part of the inner wall of the storage compartment; a basket support frame coupled to the third hinge and the fourth hinge and configured to rotate between the entrance and a maximum opening angle of the door; a pair of vertical frame parts, each forming a portion of a respective basket support frame, each of the vertical frame parts being configured such that at least a portion of each of the vertical frame parts is spaced apart from a respective inner wall of the storage compartment when each of the vertical frame parts is located at the entrance and at least a portion of each of the vertical frame parts is spaced apart from the respective inner side of the door when each of the vertical frame parts is coupled to the respective inner side of the door, each of the vertical frame parts having a handle part configured for rotating the respective basket support frame; a pair of horizontal frame parts, each forming a portion of a respective basket support frame and being connected to a respective vertical frame part; a basket that includes a bottom mounted to a respective horizontal frame part, a front portion located in the door storage space part when the basket is coupled to the inner side of the door, and a rear portion located outside the door storage space part when the basket is coupled to the inner side of the door; a locking device configured to selectively couple the basket assembly and the door; and a release device configured to release the locking device to separate the basket support frame and the door from each other.

These and other implementations can each optionally include one or more of the following features. The release device is configured to release the locking device and is accessible from an outside and an inside of the door. The release device includes a first release part configured to be operated from the outside of the door when the door is closed; and a second release part configured to be operated from the inside of the door when the door is opened.

DETAILED DESCRIPTION

Figure 1:
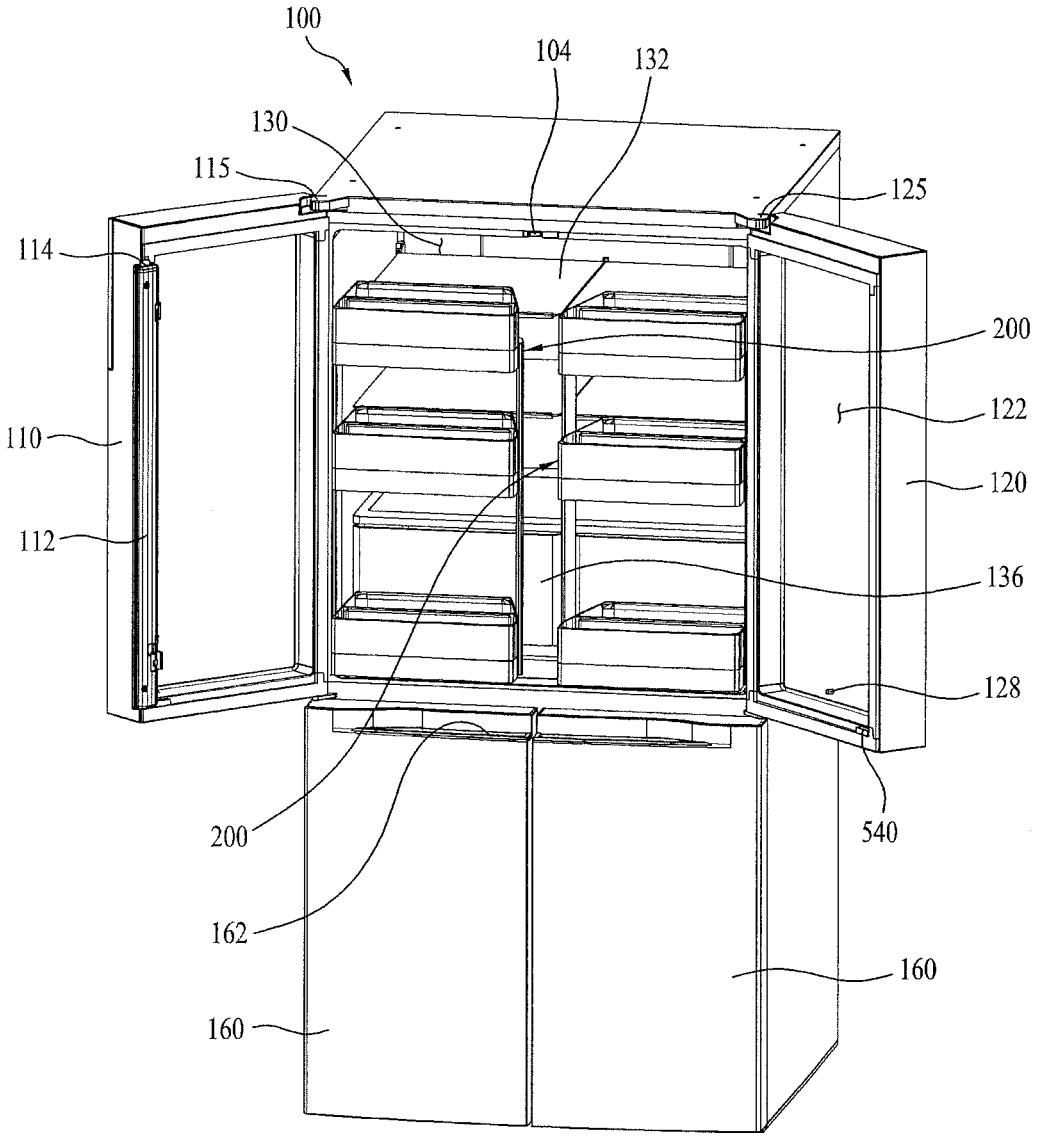
FIG. 1 is a perspective view of an example refrigerator with an open refrigerator compartment door.
Figure 2:
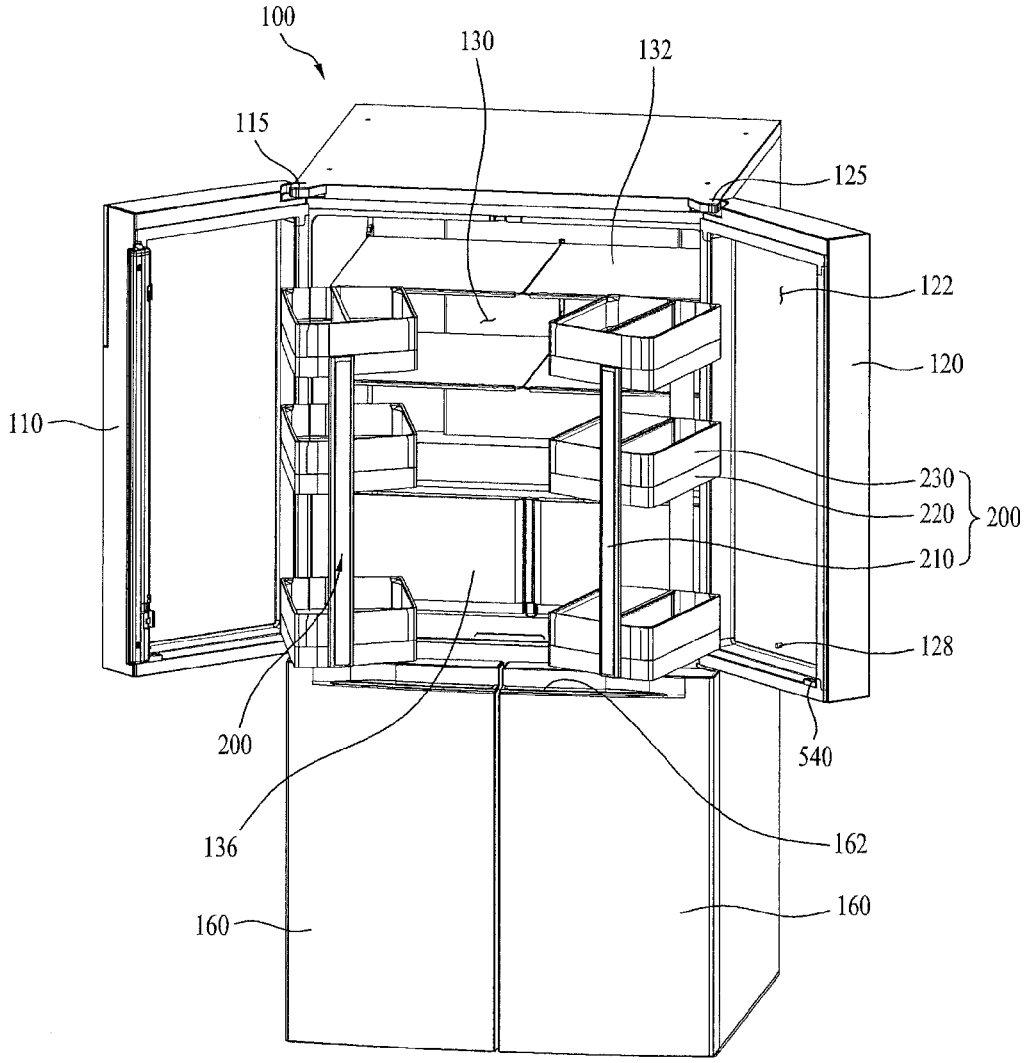
FIG. 2 is a perspective view of an example refrigerator with a pivoted basket assembly.
Figure 3:
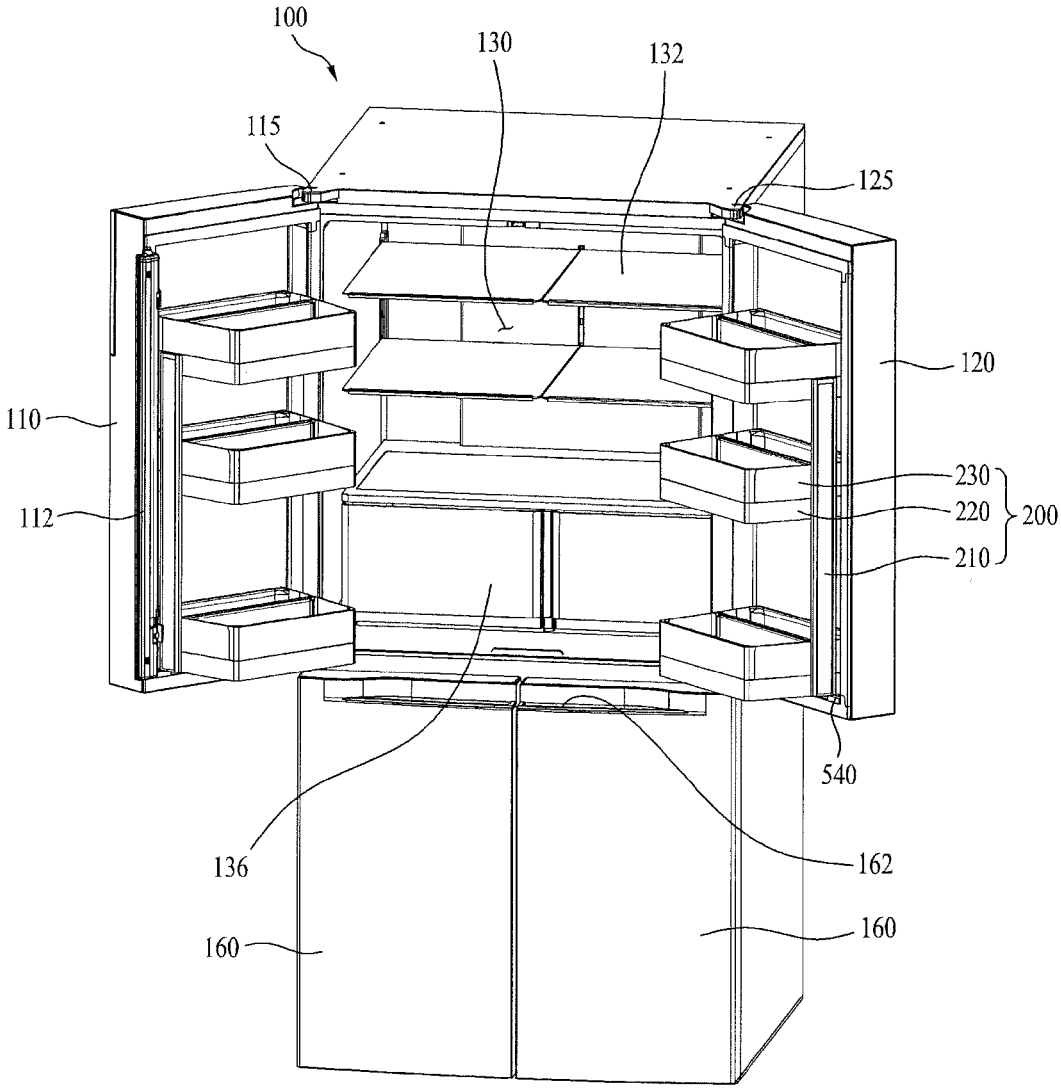
FIG. 3 is a perspective view of an example refrigerator with a pivoted basket assembly that is coupled to the open refrigerator compartment door.
Figure 4:
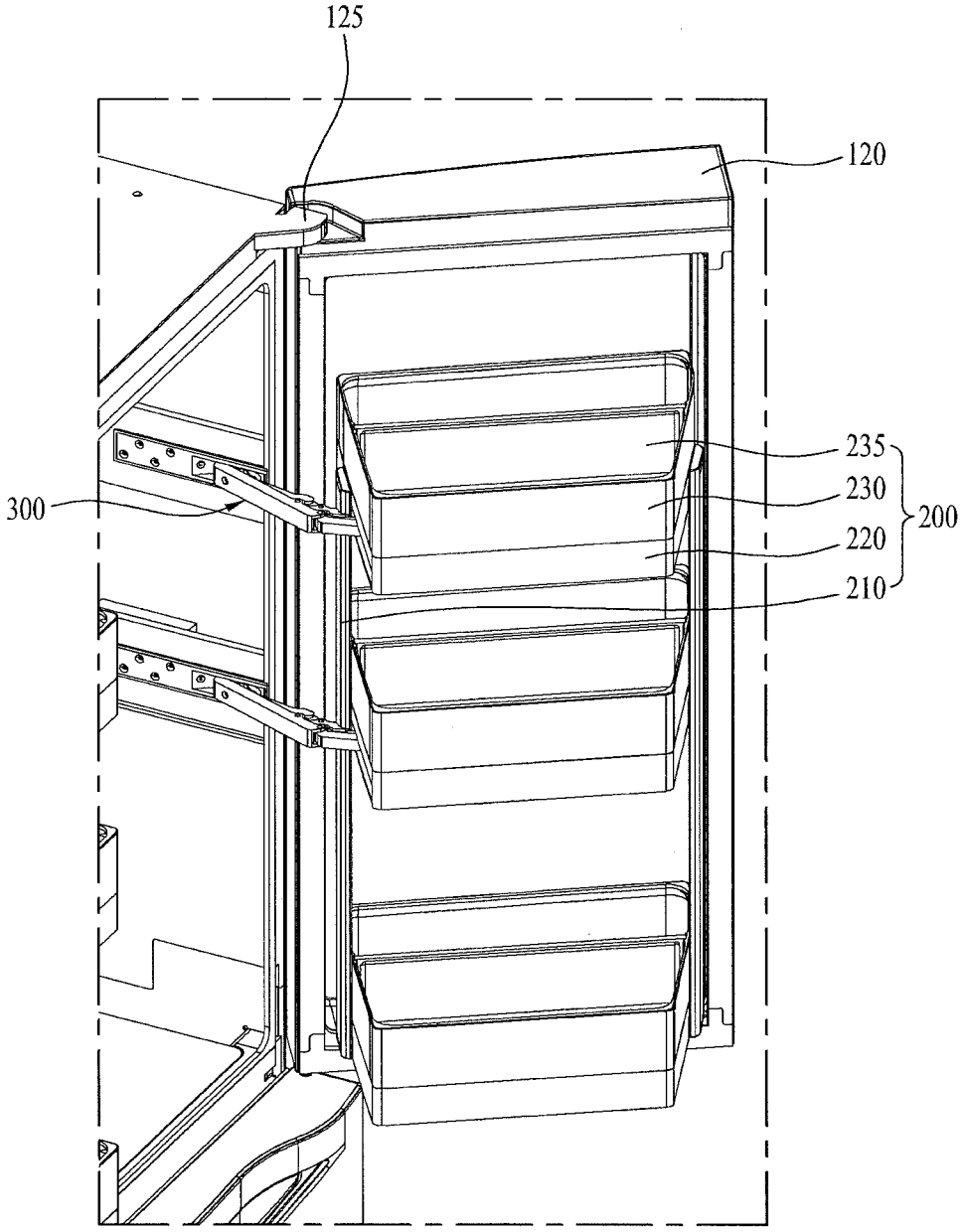
FIG. 4 is a partial perspective view of an example right side refrigerator compartment door and basket assembly that are pivotably mounted by a hinge and a multi-articulated hinge, respectively.

FIG. 1 is a perspective view of an example refrigerator with an open refrigerator compartment door. FIG. 2 is a perspective view of an example refrigerator with a pivoted basket assembly. FIG. 3 is a perspective view of an example refrigerator with a pivoted basket assembly that is coupled to the open refrigerator compartment door. FIG. 4 is a partial perspective view of an example right side refrigerator compartment door and basket assembly that are pivotably mounted by a hinge and a multi-articulated hinge, respectively.

The refrigerator includes a cabinet 100 having a storage compartment provided therein, a pair of doors 110 and 120 pivotably mounted at opposite sides of the cabinet for opening and closing the storage compartment, a pair of basket assemblies 200 pivotably supported by a hinge mounted at the inner side of the storage compartment, a locking device for selectively coupling the basket assemblies and the doors, and a release device for releasing the locking device at the inside and the outside of the doors.

The refrigerator shown in FIGS. 1 to 4 is a bottom freezer type refrigerator, in which a refrigerator compartment 130 is provided at the upper part of the cabinet 100 and a freezer compartment is provided at the lower part of the cabinet 100.

In FIGS. 1 to 4, a pair of refrigerator compartment doors 110 and 120 are pivotably mounted at the right and left sides of the upper part of the cabinet 100 by a pair of hinges 115 and 125, respectively, as the doors for opening and closing the refrigerator compartment 130.

The hinges 115 and 125 are not only disposed at the upper ends of the refrigerator compartment doors 110 and 120 but also disposed at the lower ends of the refrigerator compartment doors 110 and 120 for pivotably supporting the refrigerator compartment doors 110 and 120.

The hinges mounted at the upper part of the cabinet 100 may be referred to as first hinges and the hinges mounted at a partition wall for partitioning the refrigerator compartment and the freezer compartment from each other may be referred to as second hinges.

The refrigerator compartment doors 110 and 120 open and close an opening, i.e. an entrance, formed at the front of the refrigerator compartment 130.

The refrigerator compartment doors 110 and 120 may be provided symmetrical to each other.

A filler 112 for sealing a gap defined between the refrigerator compartment doors 110 and 120 may be mounted at an end of the inside of the left side refrigerator compartment door 110.

The filler 112 may seal the gap between the two refrigerator compartment doors while being pivoted by a pivoting guide groove 104 formed at the middle of the upper part of the cabinet 100.

The filler 112 is provided at the upper end thereof with a protrusion 114 protruding upward. The pivoting guide groove 104 guides movement of the protrusion 114 such that the filler 112 can be pivoted when the left side refrigerator compartment door 110 is closed and thus contacts the cabinet 100.

The filler 112 may be pivotably mounted at the left side refrigerator compartment door 110. As the protrusion 114 is inserted into the pivoting guide groove 104 and movement of the protrusion 114 is guided by the pivoting guide groove 104, the filler 112 may be pivoted about 90 degrees for sealing the gap between the left side refrigerator compartment door 110 and the right side refrigerator compartment door 120 behind the left side refrigerator compartment door and the right side refrigerator compartment door.

A door for opening and closing the freezer compartment may also include a pair of freezer compartment doors 160 pivotably mounted at the left side and the right side of the cabinet. The freezer compartment door may be constituted by one pivotsable door or one drawer type door movable forward and backward.

The freezer compartment door 160 may be provided at the upper end thereof with a handle groove 162 configured such that a user can pull the freezer compartment door while holding the handle groove to open the freezer compartment door.

The refrigerator compartment door 120 may be provided at the bottom thereof with a handle groove 125, which will hereinafter be described with reference to FIG. 9.

In the front of a receiving space of the refrigerator compartment 130 are received the basket assemblies 200, which are pivotably supported at opposite side walls of the refrigerator compartment 130.

In the rear of the receiving space of the refrigerator compartment 130 may be disposed a drawer 136, which is located at the lower part of the refrigerator compartment behind the space of the refrigerator compartment in which the basket assemblies 200 are received, and a plurality of shelves 132 may be disposed above the drawer.

One drawer 136 may be provided such that the drawer 136 can be withdrawn. Since the left and right width of the refrigerator compartment is considerably large in the bottom freezer type refrigerator, however, two or more drawers may be mounted.

The shelves 132 may be supported by a cantilever, the rear end of which is inserted into a support rail fixed to a rear wall of the refrigerator compartment 130. In some implementations, the shelves may be supported by a guide rib formed at an inside wall of the refrigerator compartment 130 in a protruding state.

In a case in which the shelves 132 are supported by the cantilever, as shown in FIG. 3, two or more shelves may be securely supported by a plurality of cantilevers since the left and right width of the refrigerator compartment 130 is large. In addition, two or more shelves may be installed at different heights.

As shown in FIG. 4, the basket assembles 200 may be supported by a multi-articulated hinge 300 connected between the inside wall of the refrigerator compartment 130 and the basket assembles 200 via a plurality of links.

Specifically, two multi-articulated hinges 300 may be connected to one basket assembly 200.

The structure and coupling of the multi-articulated hinges 300 will hereinafter be described in detail.

On the other hand, the basket assembles 200 may be pivotably mounted by a pair of general hinges mounted at the upper part and the lower part of the inner wall of the refrigerator compartment 130 as well as the multi-articulated hinges 300.

The multi-articulated hinges 300 or the hinges supporting the basket assembles 200 may be referred to as third and fourth hinges in consideration of the fact that the hinges of the refrigerator compartment door 120 are referred to as the first and second hinges.

The basket assembles 200 may be selectively coupled to the refrigerator compartment doors 110 and 120 by the locking device.

In a case in which the basket assembles 200 are coupled to the refrigerator compartment doors 110 and 120, the refrigerator compartment doors 110 and 120 are pivoted together with the basket assembles 200 when the refrigerator compartment doors 110 and 120 are pulled open.

In a case in which the basket assembles 200 are separated from the refrigerator compartment doors 110 and 120, on the other hand, only the refrigerator compartment doors 110 and 120 are pivoted when the refrigerator compartment doors 110 and 120 are pulled open.

Consequently, the basket assembles 200 may be pivoted between the entrance of the refrigerator compartment 130 and the maximum opening angle of the refrigerator compartment doors 110 and 120.

In addition, the release device is provided to selectively release the locking device. The release device may be provided to release the locking device at the inside and the outside of the refrigerator compartment doors 110 and 120.

That is, a user may operate the release device at the outside of the refrigerator compartment doors in a state in which the refrigerator compartment doors 110 and 120 are closed. In addition, the user may operate the release device at the inside of the refrigerator compartment doors even in a state in which the refrigerator compartment doors 110 and 120 are open while being coupled to the basket assembles 200.

The structure and operation of the locking device and the release device will hereinafter be described in detail.

As shown in FIG. 1, a gap may be provided between the basket assembles 200 such that one of the basket assembles does not interfere with the other basket assembly when being pivoted in a case in which the basket assembles 200 are disposed at the inside of the storage compartment.

In order to efficiently utilize a storage space of the storage compartment, a very small gap may be provided between the basket assembles 200 such that pivoting tracks of corresponding ends of the basket assembles 200 do not interfere with each other.

As the forward and backward size of the basket assembles 200 is increased and a large number of heavy objects are received in the basket assembles, however, a possibility of interference is increased.

In addition, it may be difficult for the user to pull the basket assembles 200 while inserting a finger into the gap between the basket assembles so as to pivots the basket assembles. Furthermore, when the basket assembles 200 are pivoted into the refrigerator compartment 130, the finger may be caught in the gap between the basket assembles with the result that the finger may be damaged.

For this reason, a sufficient gap may be provided between the basket assembles 200.

A concave part 122 may be formed at the rear of the refrigerator compartment door 120 for receiving a portion of the front part of the basket assembly 200.

In this case, it may be necessary to provide a sufficient gap between the basket assembles 200 such that the basket assembles 200 are received in the concave parts 122 formed at the rears of the refrigerator compartment doors 110 and 120.

Hereinafter, the structure and coupling of the multi-articulated hinge and the basket assembly will be described in detail with reference to FIGS. 5 to 7.

Figure 5:
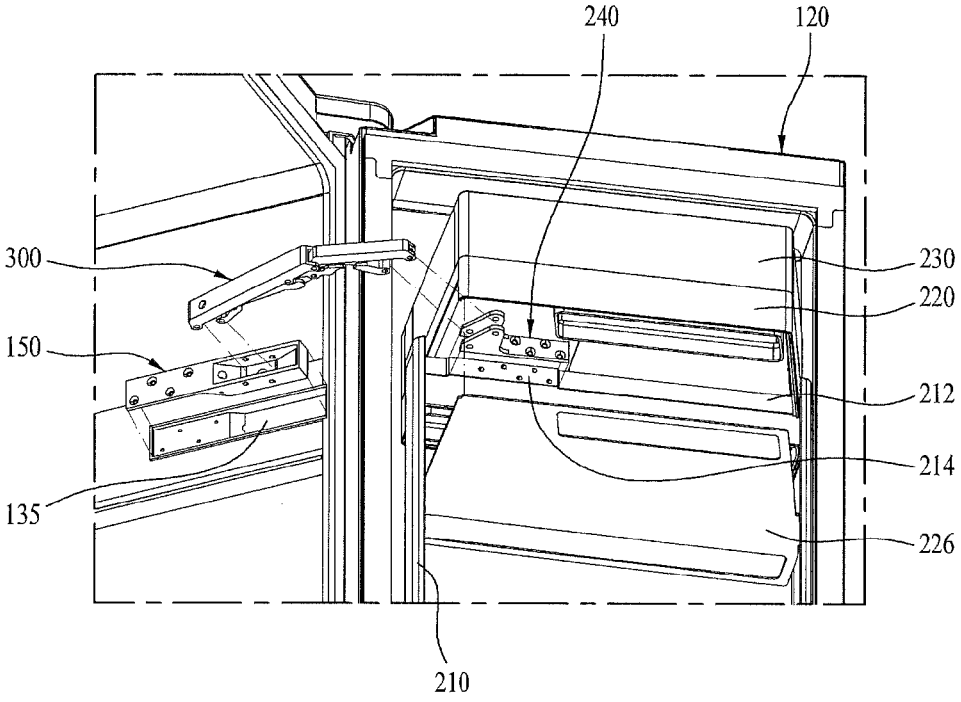
FIG. 5 is a partially exploded perspective view of an example fastening region of a multi-articulated hinge.

As shown in FIG. 5, one end of the multi-articulated hinge 300 is pivotably connected to a hinge bracket 150 which is disposed in a groove 135 formed at the side wall of the refrigerator compartment 130 and is fastened and fixed by a plurality of fastening members, such as screws.

The other end of the multi-articulated hinge 300 is pivotably connected to a frame bracket 240 fastened and fixed to a frame for structurally supporting the basket assembly 200 by a plurality of fastening members, such as screws.

The frame bracket 240 may be fastened to a fastening part 214, provided at the frame, having a plurality of fastening holes.

The basket assembly 200 may include a frame fastened to the end of the multi-articulated hinge 300 and a plurality of baskets 230 mounted at the frame.

The bottoms of the baskets 230 are supported by the frame such that the baskets 230 are pivoted together with the frame.

On the other hand, the basket assembly 200 may further include a plurality of basket location parts 220 mounted at the frame for supporting the baskets 230 from bottom such that the baskets 230 are located on the basket location parts 220.

The frame may be made of a metal material exhibiting high strength unlike the baskets 230 each mainly made of a plastic material.

In addition, the frame may include a pair of vertical frame parts 210 spaced apart from each other in parallel and three horizontal frame parts 212 connected between the vertical frame parts 210.

In this case, the frame bracket 240 may be fastened to fastening parts 214 provided at two upper ones of the three horizontal frame parts 212.

The vertical frame parts 210 and the horizontal frame parts 212 are generally formed in a shape of "日" to have a structure exhibiting high strength.

As shown in FIG. 5, each basket location part 220 may be assembled by disposing the basket location part 220 at the horizontal frame parts 212 in a state in which a bottom surface 226 is separated from the basket location part 220 and coupling the bottom surface 226 to the basket location part 220.

The basket location part 220 may be provided at one side thereof with a horizontally long hole 222, in which pivoting of the multi-articulated hinge 300 coupled to the horizontal frame parts 212 received in the inner space thereof is allowed.

Figure 6:
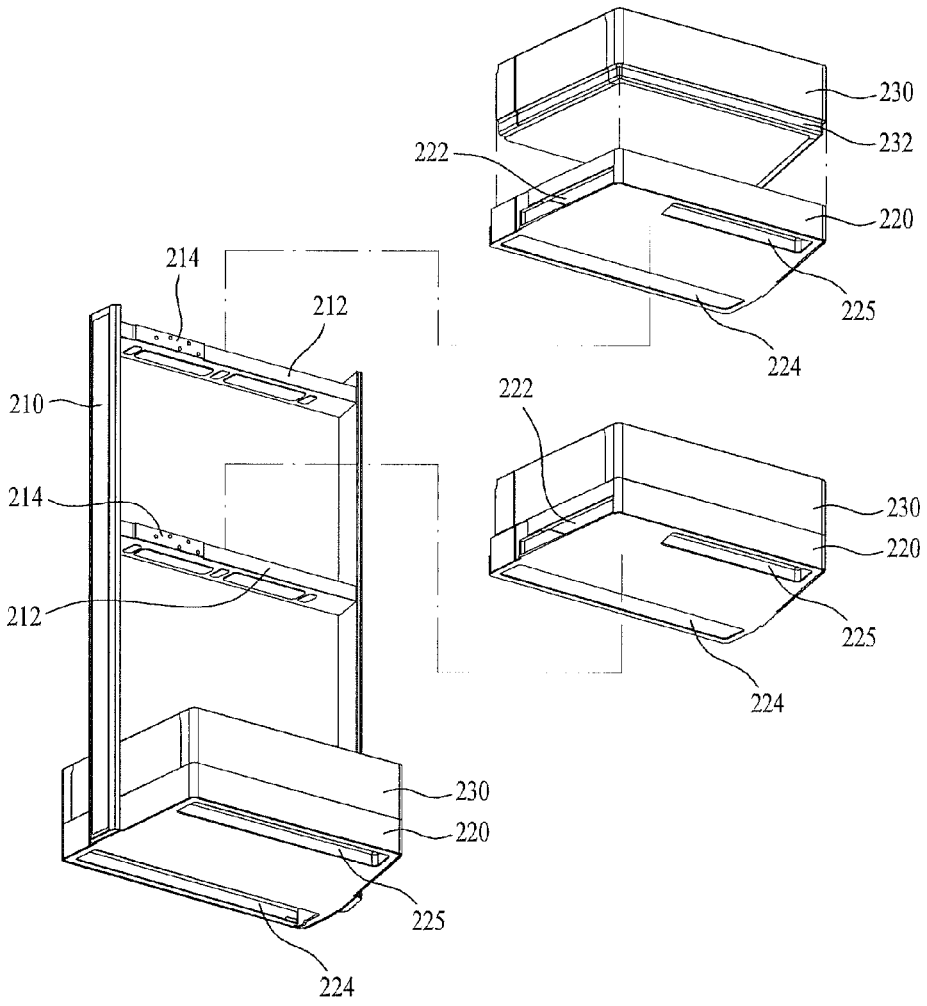
FIG. 6 is an exploded perspective view of an example basket assembly.

FIG. 6 is a partially exploded perspective view of the basket assembly 200 behind the right side refrigerator compartment door 120 when viewed from rear. The long hole 222 is formed at the left side wall of each basket location part 220.

That is, one end of the multi-articulated hinge 300 is connected to the frame bracket 240 fastened to the rear of each horizontal frame part 212 through the long hole 222 and the other end of the multi-articulated hinge 300 is connected to the hinge bracket 150 fastened and fixed to the side of the refrigerator compartment 130.

As described above, two multi-articulated hinges 300 are connected to one basket assembly 200. As shown in FIG. 6, therefore, it can be seen that the long holes 222 may be formed at the basket location parts 220 mounted at two upper ones of the three horizontal frame parts 212.

On the other hand, the lowermost basket location part 220 may be provided with a hole, through which the horizontal frame part 212 extends.

Each basket 230 is located and supported in a concave part provided at the upper part of a corresponding one of the basket location parts 220.

As shown in FIG. 6, the lower part of the side of each basket 230 is less in horizontal sectional size than the upper part of the side of each basket 230 with the result that a step part 232 may be formed at each basket 230.

The step part 232 is inserted and located in the concave part of each basket location part 220. The outside of each basket location part 220 may have the same plane as that of a corresponding one of the baskets 230.

As shown in FIG. 4, the inner space of each basket 230 may be partitioned by a horizontally disposed separation wall 235.

The separation wall 235 enables efficient use of the space of the basket 230 when objects smaller than the width of the basket 230 are received in the basket 230 and, in addition, prevents the objects received in the basket 230 from moving due to the moment of inertia when the basket 230 is pivoted.

The separation wall 235 may be detachably provided at each basket 230.

When large objects are received in the basket 230, therefore, the separation wall 235 may be separated from the basket 230.

In addition, as shown in FIG. 6, handle grooves 224 and 225 may be provided at the bottom of each basket location part 220.

On the assumption that one of the handle grooves 224 and 225 adjacent to the refrigerator compartment door 120 is a first handle groove 224 and the other of the handle grooves 224 and 225 away from the refrigerator compartment door 120 is a second handle groove 225, the first handle groove 224 may be formed to be longer than the second handle groove 225.

Subsequently, the multi-articulated hinge will be described with reference to FIGS. 5 and 7.

As previously described, opposite ends of the multi-articulated hinge may be pivotably connected to the hinge bracket 150 mounted at the inside wall of the refrigerator compartment 130 and the frame bracket 240 mounted at the fastening part 214 of the horizontal frame part 212 in a state in which the multi-articulated hinge is disposed between the hinge bracket 150 and the frame bracket 240.

In the multi-articulated hinge 300, a total of four links are connected between the hinge bracket 150 and the frame bracket 240 via a plurality of pivoting pins P.

Figure 7:
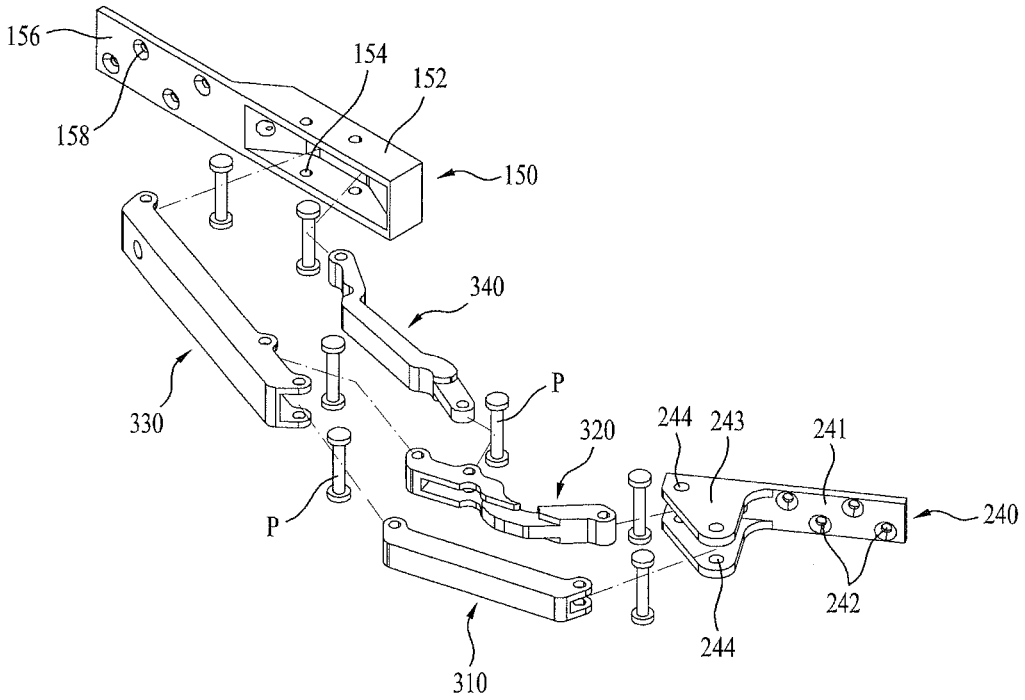
FIG. 7 is an exploded perspective view of an example multi-articulated hinge.

As shown in FIG. 7, the hinge bracket 150 includes a fixing part 156 fastened and fixed to the inside wall of the refrigerator compartment 130 by a plurality of fastening members and a link coupling part 152, to which one end of each of two links is pivotably coupled via a corresponding one of the pivoting pins P.

The fixing part 156 is provided with a plurality of fastening holes 158, through which fastening members, such as screws, can extend.

The link coupling part 152 is inserted into the groove 135 formed at the side wall of the refrigerator compartment 130 such that the link coupling part 152 more protrude backward than the fixing part 156.

The link coupling part 152 does not protrude from the inner side of the refrigerator compartment 130 when the link coupling part 152 is mounted at the inside wall of the refrigerator compartment 130 to minimize the storage space of the refrigerator compartment occupied by the hinge bracket 150.

At the front side of the link coupling part 152 is formed a concave part, in which one end of each of the two links is received and the concave part is provided at the top and bottom thereof with two pairs of pin holes 154, through which the pivoting pins P are inserted.

The frame bracket 240 includes a fixing part 241 fastened and fixed to the fastening part 214 provided at the horizontal frame part 212 of the basket assembly 200 and a link coupling part 243, to which one end of each of two links is pivotably coupled via a corresponding one of the pivoting pins P inserted through pin holes 244.

The fixing part 241 is provided with a plurality of fastening holes 242, through which fastening members, such as screws, can extend.

The four links may include a first link 310 and a second link 320 pivotably connected to the frame bracket 240 via corresponding ones of the pivoting pins P and a third link 330 and a fourth link 340 pivotably connected to the hinge bracket 150 via corresponding ones of the pivoting pins P.

One end of the first link 310 and one end of the third link 330 are pivotably connected to each other via a corresponding one of the pivoting pins P. One end of the second link 320 and a middle part of the third link 330 are pivotably connected to each other via a corresponding one of the pivoting pins P.

In addition, a middle part of the second link 320 and one end of the fourth link 340 are pivotably connected to each other via a corresponding one of the pivoting pins P.

The first link 310 and the third link 330 may be formed in a bracket shape in vertical section, whereas the second link 320 and the fourth link 340 may be formed in a bar shape.

Since the middle part of the second link 320 is connected to the fourth link 340, however, the middle part of the second link 320 may be formed in a shape of two parallel plates having pin holes, through which the pivoting pins P may be inserted.

The four links may be integrally manufactured as a single part. In addition, the four links may be made of a metal material together with the hinge bracket 150 and the frame bracket 240 to provide sufficient strength.

The first link 310 and the third link 330 each are generally formed in a straight line, whereas the second link 320 and the fourth link 340 each are formed such that a middle part of each of the second link 320 and the fourth link 340 is slightly bent.

In addition, a support groove for restricting relative pivoting of each of the second link 320 and the fourth link 340 may be formed at one side of the bent part of each of the second link 320 and the fourth link 340.

In particular, the middle part of each of the second link 320 and the fourth link 340 may be bent twice. As a result, two support grooves may be formed at one sides of the two bent parts of each link.

When the four links are pivoted, the respective pivoting pins P contact and are supported by the support grooves. Consequently, the support grooves may restrict the maximum pivoting angle of each link.

FIGS. 8A to 8D are plan views showing that the right side refrigerator compartment door and the basket assembly are pivoted relative to the cabinet.

The right side refrigerator compartment door 120 is pivotably mounted at the cabinet 100 by the hinge 125 as shown in FIGS. 1 to 4.

Figure 8A:
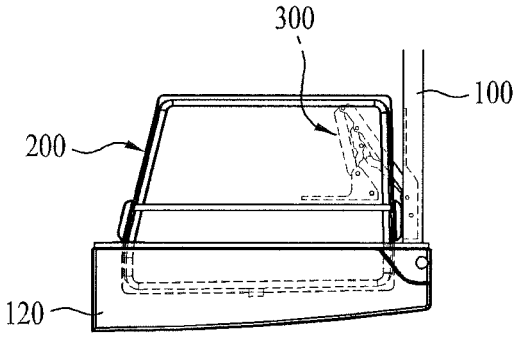
FIGS. 8A to 8D are plan views of an example right side refrigerator compartment door and basket assembly.

As shown in FIG. 8A, the basket assembly 200 is pivotably mounted by the multi-articulated hinge 300 separately from the refrigerator compartment door 120 but the refrigerator compartment door 120 is closed in a state in which the basket assembly 200 is coupled to the refrigerator compartment door 120.

Figure 8B:
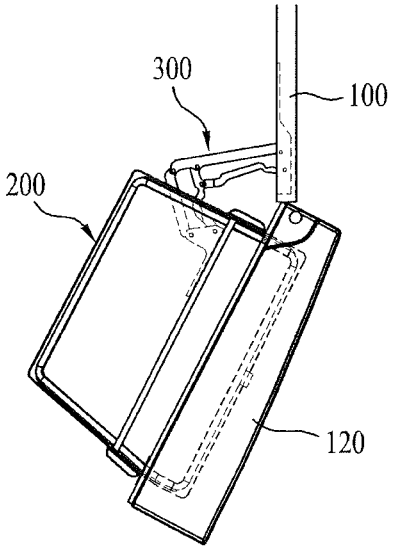

When a user pulls the refrigerator compartment door 120 without releasing the coupled state between the refrigerator compartment door 120 and the basket assembly 200, the refrigerator compartment door 120 is pivoted in a state in which the basket assembly 200 is coupled to the refrigerator compartment door 120 as shown in FIG. 8B.

Figure 8C:
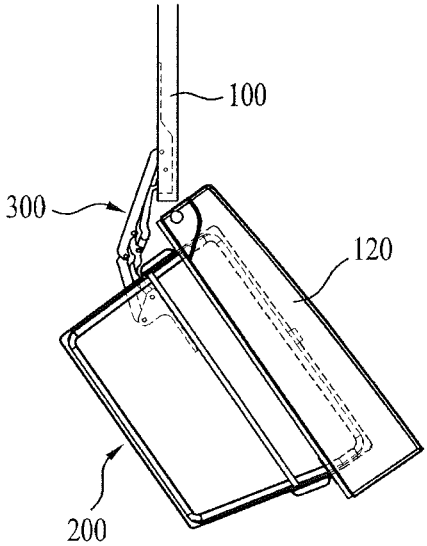

When the user further pulls the refrigerator compartment door 120 in a state of FIG. 8B, refrigerator compartment door 120 is further pivoted and opened in a state in which the basket assembly 200 is coupled to the refrigerator compartment door 120 as shown in FIG. 8C.

Figure 8D:
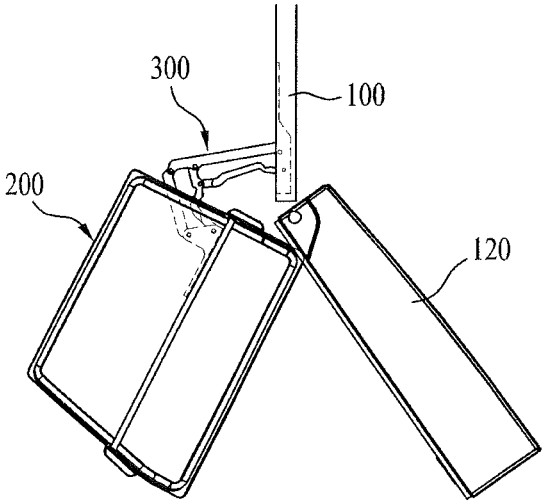

When the user pushes a release button 540 (see FIG. 3) provided at the inside of the refrigerator compartment door 120 in a state of FIG. 8C, the basket assembly 200 may be separated from the refrigerator compartment door 120 as shown in FIG. 8D.

As can be seen from FIGS. 8A to 8D, the moving track of the front of the basket assembly 200 pivoted while being supported by the multi-articulated hinge 300 may coincide with that of the rear of the refrigerator compartment door 120.

Meanwhile, when each vertical frame part 210 is disposed at the entrance of the refrigerator compartment 130 as shown in FIG. 1, at least a portion of the vertical frame part 210 is disposed so as to be spaced apart from the inner wall of the refrigerator compartment 130.

That is, one of the vertical frame parts 210 opposite to the pivoting shaft of the basket assembly 200 is spaced so as to be apart from the inner wall of the refrigerator compartment 130.

In a case in which a pair of basket assemblies 200 are disposed as shown in FIG. 1, adjacent two vertical frame parts 210 of the basket assemblies 200 may be disposed so as to be spaced apart from each other.

In addition, in a case in which each vertical frame part 210 is coupled to the inner side of the refrigerator compartment door 120 as shown in FIG. 3, at least a portion of the vertical frame part 210 is disposed so as to be spaced apart from the inner side of the refrigerator compartment door 120.

The spaced gap may be a distance in which it is possible for the user to pull the basket assembly 200 while inserting a finger into the gap.

Consequently, each vertical frame part 210 may function as a handle for allowing the user to pivots the basket assembly 200.

In some implementations, a handle may be provided at each vertical frame part 210 in the shape of a groove or a protrusion.

When the user wishes to pivots the basket assembly 200, the user may move the basket assembly 200 while holding the basket 230 or the handle grooves 224 and 225 of the basket location part 220. In some implementations, the user may move the basket assembly 200 while holding the vertical frame part 210 or the handle of the vertical frame part 210.

Hereinafter, the structure and operation of the locking device and the release device will be described with reference to FIGS. 9 to 13B.

Figure 9:
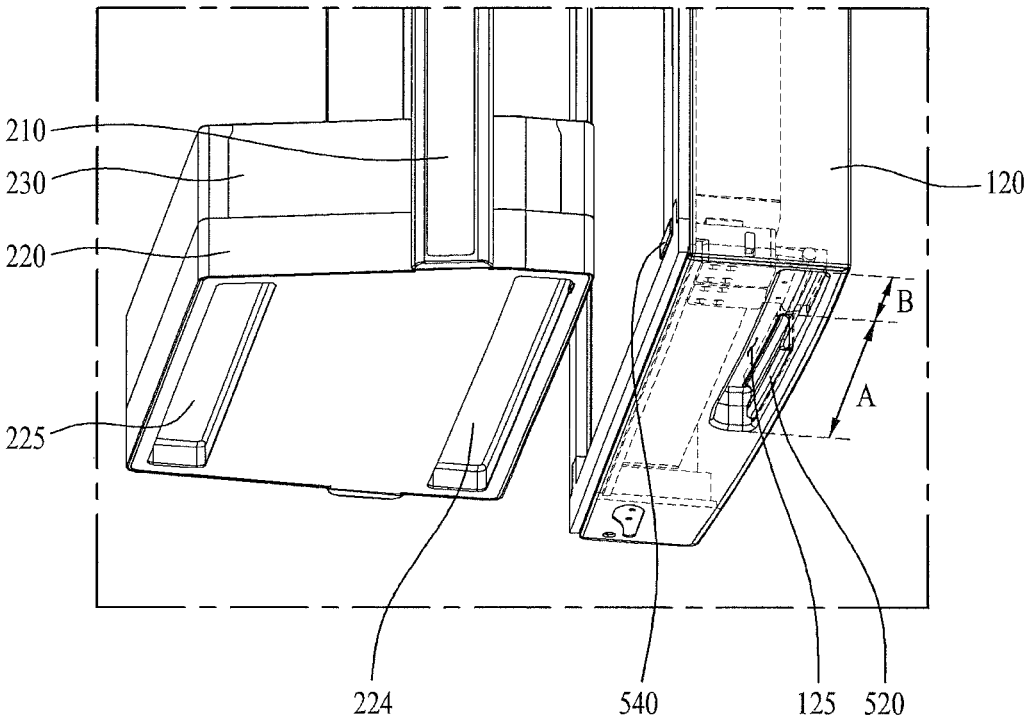
FIG. 9 is a partial perspective view of an example basket assembly and right side refrigerator compartment door when viewed from the bottom.

As shown in FIG. 9, the refrigerator compartment door 120 is provided at the bottom thereof with a handle groove 12.

A release lever 520 is pivotably mounted in the handle groove 125.

When the user pulls the handle groove 125 forward while holding a section A, the release lever 520 is pivoted and operated. On the other hand, when the user pulls the handle groove 125 forward while holding a section B, the release lever 520 is not operated. As a result, the refrigerator compartment door 120 is opened in a state in which the basket assembly 200 is coupled to the refrigerator compartment door 120.

In addition, a release button 540 is provided at the lower part of the inside of the refrigerator compartment door 120 such that the release button 540 can slide forward and backward.

The release lever 520 and the release button 540 are operated by the user to push a slider 420, which will hereinafter be described, downward.

Figure 10:
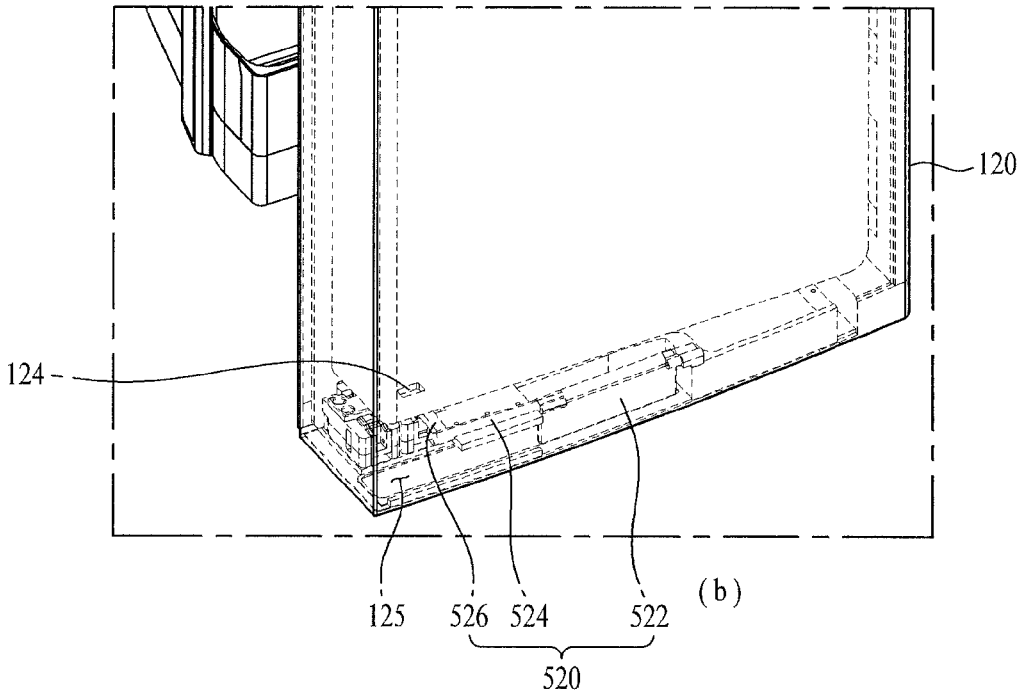
FIG. 10 is a perspective view showing the interior of an example right side refrigerator compartment door.

As shown in FIG. 10, the release lever 520 includes a pivoting shaft part 524 mounted at the upper part of the handle groove 125 and a lever part 522 extending downward only from the right side of the pivoting shaft part 524.

In addition, the release lever 520 further includes an arm part 526 extending backward from the left side end of the pivoting shaft part 524.

FIG. 10 shows the right side refrigerator compartment door 120. The left side refrigerator compartment door 120 is disposed in symmetry to the right side refrigerator compartment door 120.

In brief, the lever part 522 is disposed in the handle groove 125 such that the lever part 522 is adjacent to the pivoting shaft of the refrigerator compartment door 120.

Meanwhile, the refrigerator compartment door 120 is provided at the bottom of the inside thereof with a through hole 124, through which the upper end of the slider 420 can extend.

In addition, as shown in FIG. 9, the first handle groove 224 is formed at the bottom of the basket location part 220 of the basket assembly 200 such that the first handle groove 224 is adjacent to the refrigerator compartment door 120 and the second handle groove 225 is formed at the bottom of the basket location part 220 of the basket assembly 200 such that the first handle groove 224 is away from the refrigerator compartment door 120.

Figure 11:
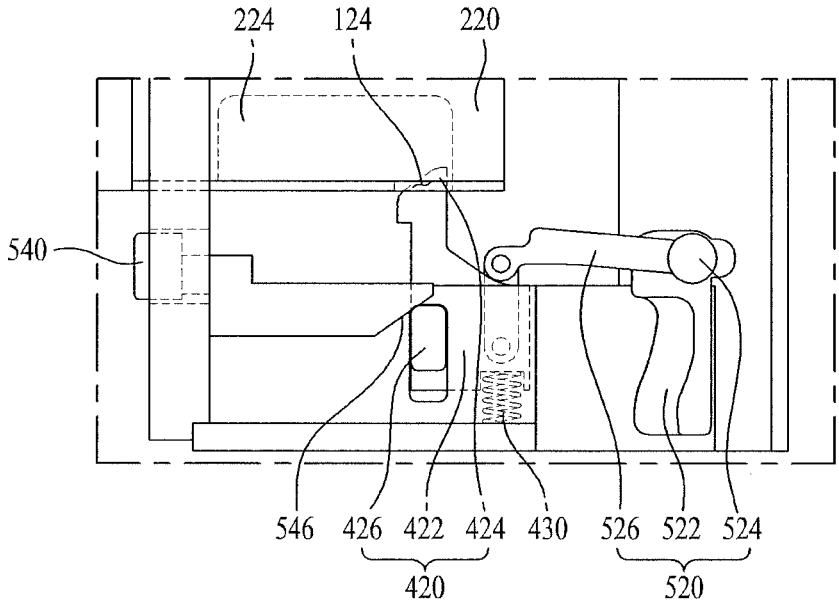
FIG. 11 is a side view of an example slider, release lever, and release button.

As shown in FIG. 11, a slider 420 is slidably mounted at the lower part of the refrigerator compartment door 120 such that the slider 420 can slide downward by the release lever 520 or the release button 540.

When the basket assembly 200 is coupled to the rear of the refrigerator compartment door 120, the first handle groove 224 of the basket location part 220 is located above an upper end 424 of the slider 420.

At this time, the upper end of the slider 420 protrudes upward through the through hole 124 of the refrigerator compartment door 120 and one side of the slider 420 is caught by one side of the first handle groove 224.

As a result, the upper end of the slider 420 is selectively inserted and caught in the first handle groove 224. For this reason, the upper end 424 may be referred to as a "catching protrusion."

In addition, the first handle groove 224 is larger than the catching protrusion 424 such that a finger can be inserted into the first handle groove 224. Since the catching protrusion 424 is caught by one side of the first handle groove 224. For this reason, the first handle groove 224 may be referred to as a "catching groove."

The top of the catching protrusion 424 is inclined to one side. When the basket assembly 200 is pushed to the refrigerator compartment door 120, therefore, the catching protrusion 424 is moved downward such that the basket assembly 200 can be coupled to the refrigerator compartment door 120.

Figure 12:
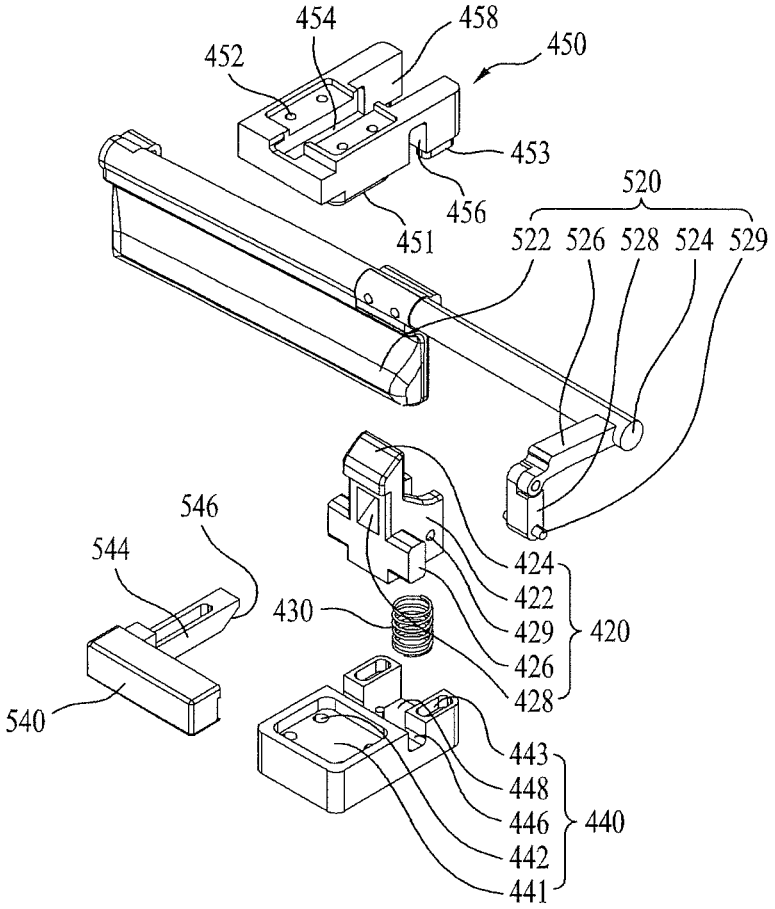
FIG. 12 is an exploded perspective view of an example slider, release lever, and release button.

FIG. 12 is an exploded perspective view showing a coupling relationship among the slider, the release lever, and the release button.

The release lever 520 includes the lever part 522 extending downward from one side of the pivoting shaft part 524 and the arm part 526 extending backward from the other end of the pivoting shaft part 524.

A vertical pivoting part 528 may be pivotably connected to an end of the arm part 526 and a pair of coupling protrusions 529 may be provided at opposite sides of an end of the vertical pivoting part 528.

A guide groove may be formed at the lower part of the refrigerator compartment door 120 such that the slider 420 can be slidably mounted in the guide groove. In some implementations, the slider 420 may be mounted at the lower part of the refrigerator compartment door 120 using additional guides.

For example, the slider 420 may be assembled between a lower guide 440 and an upper guide 450 such that vertical movement of the slider 420 can be guided.

The lower guide 440 may include a first groove 411 and a pair of second grooves 443 formed at the upper side thereof for coupling between the lower guide 440 and the upper guide 450. A plurality of fastening holes 442 for fastening screws may be provided in the first groove 411.

Correspondingly, the upper guide 450 may include a first protrusion 451 and a pair of second protrusions 453 formed at the lower side thereof. A plurality of fastening holes 542 may be provided at a position at which the first protrusion 451 is located.

In addition, the slider 420 may include the catching protrusion 424 extending upward, a pair of guide protrusions 426 protruding outward from side walls 422 thereof, and an inclined hole 428 formed at the middle part thereof.

The vertical pivoting part 528 is received between the side walls 422 and coupling holes 429, into which the coupling protrusions 529 are inserted, are formed at the side walls 422. Consequently, the vertical pivoting part 528 of the release lever 520 is coupled to the slider 420.

Guide grooves 446 and 456 for receiving the guide protrusions 426 of the slider 420 to guide vertical movement of the guide protrusions 426 are formed at the lower guide 440 and the upper guide 450, respectively.

In addition, the second grooves 443 are formed at the tops of upwardly protruding parts of the lower guide 440. A guide groove 448, into which the lower parts of the side walls 422 of the slider 420 are inserted such that the lower parts can vertically slide may be provided between opposite inner sides of the protruding parts at which the second grooves 443 are formed.

A guide groove 458, into which the upper parts of the side walls 422 of the slider 420 are inserted such that the upper parts can vertically slide may also be provided between opposite inner sides of the protruding parts of the upper guide 450 between the second grooves 453.

The guide groove 448 is formed at the bottom of the lower guide 440, whereas the guide groove 458 is vertically formed through the upper guide 450.

A bottom is also formed between the opposite side walls 422 of the slider 420. A groove, into which the upper end of an elastic member 430, such as a spring, is inserted, may be formed at the ceiling of the bottom.

That is, the elastic member 430 may be mounted between the groove of the slider 420 and the bottom of the lower guide 440.

The elastic member 430 pushes the slider 420 upward such that the slider 420 repivots to the original position thereof, when force for lowering the slider is removed, to prevent the locking device from being released due to gravity.

In addition, the release button 540 includes a button part, a portion of which is exposed at the rear of the refrigerator compartment door 120, an extension part 544 horizontally extending from the button part, and an inclined surface 546 formed at the front of the extension part 544.

The upper guide 450 is provided at the middle part thereof with a guide groove 454 for guiding horizontal movement of the extension part 544.

Figure 13A:
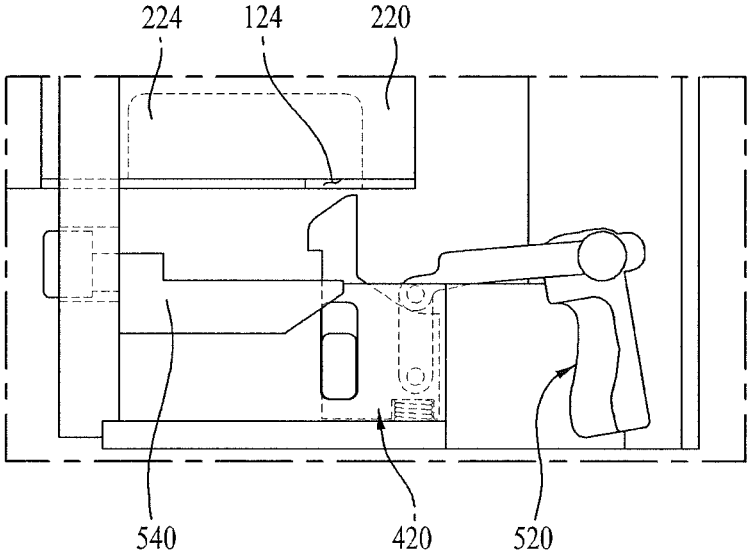
FIGS. 13A and 13B are side views of an example slider, release lever, and release button.
Figure 13B:
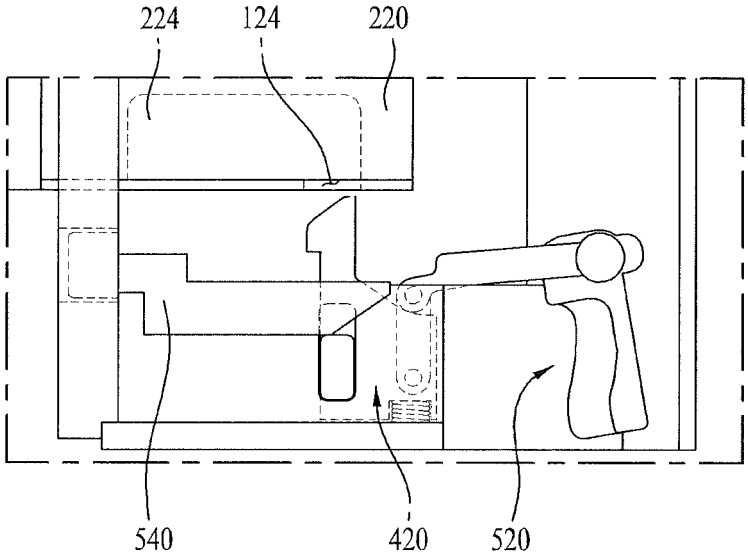

FIGS. 13A and 13B are side views showing operations of the slider, the release lever, and the release button.

When the user pivots the release lever 520, the vertical pivoting part 528 connected to the arm part 526 directly moves the slider 420 downward as shown in FIG. 13A.

On the other hand, when the user pivots the release button 540, the end of the extension part 544 is inserted into the inclined hole 428 and the inclined surface 546 pushes the inclined hole 428 to move the slider 420 downward as shown in FIG. 13B.

Since the slider 420 moves downward and the catching protrusion 424 is completely separated from the catching groove 224 in both the cases, the refrigerator compartment door 120 may be separated from the basket assembly 200.

Since the release device of the refrigerator simultaneously includes the release lever provided at the handle groove and the release button provided at the rear of the door, it is possible to selectively release the locking device in a state in which the door is open as well as in a state in which the door is closed.

In the release device, the release lever 520 may be referred as a first release part configured to be operated at the outside of the refrigerator compartment door 120 when the refrigerator compartment door 120 is closed and the release button 540 may be referred to as a second release part configured to be operated at the inside of the refrigerator compartment door 120 when the refrigerator compartment door 120 is opened.

Referring back to FIGS. 1 to 3, the concave part 122 for receiving a portion of the front part of the basket assembly 200 is formed at the rear of the refrigerator compartment door 120 as previously described.

The concave part 122 forms a storage space separated from the refrigerator compartment 130 by a step surface depressed at the edge of the inner side of the refrigerator compartment door 120.

Since the storage space is provided at the inside of the door, the storage space may be referred to as a door storage space part.

The concave part 122 may be formed to have a depth equivalent to ⅔ or more the thickness of the refrigerator compartment door 120 and opposite inner sides of the concave part 122 may be parallel to each other.

When the basket assembly 200 is coupled to the rear of the refrigerator compartment door 120, the front of the basket 230 is disposed in the door storage space part and the rear of the basket 230 is disposed at the outside of the door storage space part.

In particular, the rear of the basket 230 may be disposed in the inner space of the refrigerator compartment 130 such that the rear of the basket 230 is located more backward than the entrance thereof.

When the basket assembly 200 is coupled to the rear of the refrigerator compartment door 120, one side of the basket assembly 200 may be disposed opposite to the inner side of the concave part 122 such that one side of the basket assembly 200 is spaced apart from the inner side of the concave part 122 by a predetermined distance.

In other words, the side of the basket assembly 200 opposite to the multi-articulated hinge 300, specifically the basket location parts 220 and the outer sides of the baskets 230 are disposed opposite to the inner side of the concave part 122 of the refrigerator compartment door 120 opposite to the hinge 125 such that the basket location parts 220 and the outsides of the baskets 230 are spaced apart from the inner side of the concave part 122 of the refrigerator compartment door 120 opposite to the hinge 125 by a predetermined distance.

Consequently, even in a case in which a large number of heavy objects are received in the basket assembly 200 with the result that the multi-articulated hinge 300 is deformed due to moment and thus the basket assembly 200 is inclined to one side, the basket assembly 200 may be supported by the inner side of the concave part 122 of the refrigerator compartment door 120, thereby preventing excessive deformation of the basket assembly and damage to the basket assembly.

In addition, when the basket assembly 200 is disposed in the storage compartment as shown in FIG. 1, the bottom of the basket assembly may be disposed opposite to the bottom of the refrigerator compartment 130 such that the bottom of the basket assembly is spaced apart from the bottom of the refrigerator compartment 130 by a predetermined distance.

Even in this case, when heavy objects are received in the basket assembly 200, the bottom of the refrigerator compartment 130 supports the basket location part 220 although the multi-articulated hinge 300 is deformed. Consequently, it is possible to prevent the basket assembly from being deformed by the above distance or more When the basket assembly 200 is disposed in the refrigerator compartment 130 or coupled to the refrigerator compartment door 120, therefore, it is possible to prevent the basket assembly 200 from being excessively deformed due to the bottom of the refrigerator compartment 130 or the concave part of the refrigerator compartment door 120.

Meanwhile, as shown in FIG. 1, the refrigerator compartment door 120 may further include a repulsion member 128 provided at the rear thereof for separating the basket assembly 200 from the refrigerator compartment door 120 when the release device is operated.

In a case in which the concave part 122 is formed at the refrigerator compartment door 120, the repulsion member 128 may also be disposed at the lower part of the inner side of the concave part 122.

The moment the user releases his/her hand although the user operates the release device to release the locking device, the elastic member 430 immediately pushes the slider 420 upward with the result that the basket assembly 200 may not be separated from the refrigerator compartment door 120. The repulsion member 128 prevents the basket assembly 200 from not being separated from the refrigerator compartment door 120.

That is, when the release lever 520 or the release button 540 is operated and thus the catching protrusion 424 of the slider 420 is separated from the catching groove 224, the repulsion member 128 pushes the basket assembly 200 such that the basket assembly 200 is spaced apart from the refrigerator compartment door 120 by a predetermined distance.

Consequently, the user may operate the release device and then move the refrigerator compartment door 120 or the basket assembly 200 such that the refrigerator compartment door 120 or the basket assembly 200 is pivoted in a state in which the refrigerator compartment door 120 and the basket assembly 200 are separated from each other.

To this end, the repulsion member 128 may be made of an elastic material, such as rubber, or have an elastic member, such as a spring, disposed therein.

In addition, the repulsion member 128 may have a length slightly longer than the distance between the basket assembly 200 and the refrigerator compartment door 120 when the basket assembly 200 and the refrigerator compartment door 120 are coupled to each other for applying elastic force in a direction in which the basket assembly 200 and the refrigerator compartment door 120 are separated from each other.

Figure 14:
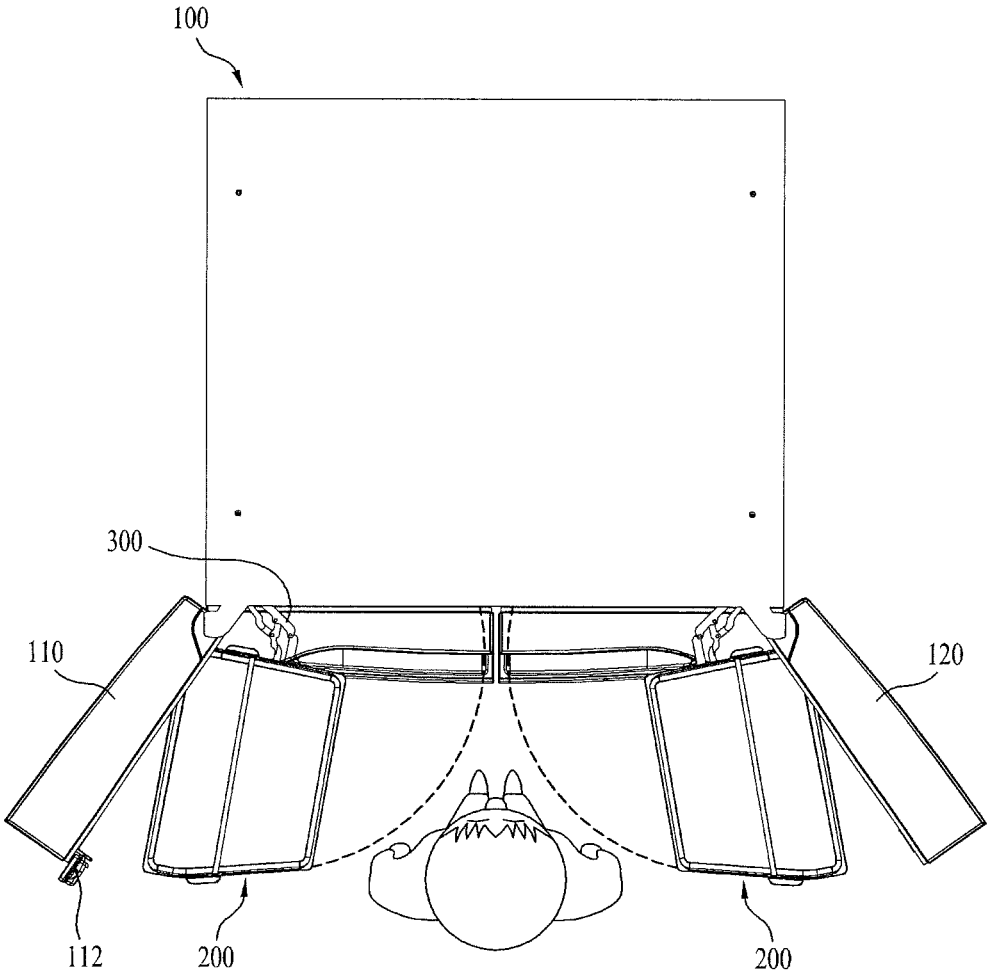
FIG. 14 is a plan view of a user in front of an example refrigerator with open refrigerator compartment doors and pivoted basket assemblies.

FIG. 14 shows that the user pivots the opposite side refrigerator compartment doors and basket assemblies in front of the cabinet.

A dotted line shown in FIG. 14 indicates a track formed by the inside end of each basket assembly 200 when the inside end of each basket assembly 200 is pivoted.

First, the user may pivots the refrigerator compartment doors 110 and 120 to opposite sides to open the refrigerator compartment doors 110 and 120. In addition, the user may pivots the basket assemblies 200 together with the doors or separately from the doors.

At this time, the user may pivots the basket assemblies 200 in a state in which the user approaches just the front of the refrigerator since the left and right width of each of the basket assemblies 200 is half or less that of the opening of the refrigerator compartment 130.

In the above description, the refrigerator includes a pair of refrigerator compartment doors and a pair of basket assemblies pivotably mounted at the rears of the refrigerator compartment doors. In some implementations, the refrigerator may include one refrigerator compartment door and one basket assembly The refrigerator compartment door is formed to have a width greater than that of an opening of the front of a refrigerator compartment such that the refrigerator compartment door can entirely open and closet the opening.

A hinge for pivotably mounting the door at the refrigerator compartment is generally disposed at the right side of the door.

The basket assembly may be pivotably mounted by a multi-articulated hinge mounted at the right side of the refrigerator compartment.

Although one basket assembly is provided, it is not necessary for the basket assembly to have an inner width approximate to that of the refrigerator compartment.

Rather, the width of the basket assembly may be less than that of the opening formed at the front of the refrigerator compartment such that the user can approach the refrigerator compartment to take an object from the refrigerator compartment when the basket assembly is disposed in the refrigerator compartment.

The difference between the width of the opening and the width of the basket assembly means the difference enabling the user to put his/her hand into the refrigerator compartment and take an object from the refrigerator compartment even when the user opens only the refrigerator compartment door without pivoting the basket assembly.

In some implementations, the width of the refrigerator compartment door and the width of the basket assembly are different from those described above.

As is apparent from the above description, the refrigerator has an effect in that the basket assembly is pivotably supported by the hinge mounted at the inside wall of the storage compartment and thus does not apply load to the door, and the frame of the basket assembly is made of a metal material, whereby it is possible to support the basket assembly with sufficient strength even when large and heavy objects are received in the basket assembly.

In addition, the refrigerator has an effect in that the release device for releasing coupling between the basket assembly and the door is provided such that the release device can be operated at the outside and the inside of the door, whereby it is possible to selectively release the locking device in a state in which the door is open as well as in a state in which the door is closed.

Furthermore, the refrigerator has an effect in that the basket assembly is pivotably mounted at the inside wall of the storage compartment by the multi-articulated hinge, whereby it is possible to more securely support the basket assembly, and that the basket assembly can be pivoted in a track identical to the pivoting track of the door.

In addition, the refrigerator has an effect in that the concave part, into which a portion of the front of the basket assembly is inserted, is formed at the inside of the door, whereby it is possible to increase the size of the basket assembly and to efficiently utilize the limited space of the storage compartment.

What is claimed is:

1. A refrigerator comprising:

a cabinet that includes a storage compartment;

a first door that is hinged on a first edge of the cabinet and that is configured to open and close a first portion of the storage compartment;

a second door that is hinged on a second edge of the cabinet and that is configured to open and close a second portion of the storage compartment;

a first basket assembly that is supported by a first hinge that is mounted at a first inner wall of the storage compartment;

a second basket assembly that is supported by a second hinge that is mounted at a second inner wall of the storage compartment;

a first locking device that is configured to selectively couple the first basket assembly to the first door, the first locking device comprising a first slider mounted to the first door and a first catching groove in the first basket assembly;

a second locking device that is configured to selectively couple the second basket assembly to the second door, the second locking device comprising a second slider mounted to the second door and a second catching groove in the second basket assembly;

a first release device that is configured to release the first locking device and that comprises:

a first release lever that is pivotably mounted at a first handle groove that is located at a bottom of the first door, the first release lever configured to be operated by a user; and a first release button that is slidably mounted at and extends from a rear of the first door, the first release button configured to be operated by a user; and a second release device that is configured to release the second locking device and that comprises:

a second release lever that is pivotably mounted at a second handle groove that is located at a bottom of the second door, the second release lever configured to be operated by a user;

a second release button that is slidably mounted at and extends from a rear of the second door, the second release button configured to be operated by a user:

wherein:

operating the first release lever releases the first slider from the first catching groove such that the first basket assembly is decoupled from the first door;

operating the second release lever releases the second slider from the second catching groove such that the second basket assembly is decoupled from the first door;

operating the first release button releases the first slider from the first catching groove such that the first basket assembly is decoupled from the first door; and operating the second release button releases the second slider from the second catching groove such that the second basket assembly is decoupled from the second door.

2. The refrigerator according to claim 1, wherein:

the first hinge is a first multi-articulated hinge that is connected to the first inner wall of the storage compartment and the first basket assembly via a first plurality of links, and the second hinge is a second multi-articulated hinge that is connected to the second inner wall of the storage compartment and the second basket assembly via a second plurality of links.

3. The refrigerator according to claim 2, wherein:
the first basket assembly comprises:
a first frame that is fastened to an end of the first multi-articulated hinge; and a first plurality of baskets that are mounted to the first frame; and
the second basket assembly comprises:
a second frame that is fastened to an end of the second multi-articulated hinge; and
a second plurality of baskets that are mounted to the second frame.

4. The refrigerator according to claim 3, wherein:
the first basket assembly further comprises:
a first plurality of basket location parts that are mounted to the first frame and that are configured to support the first plurality of baskets from a bottom of each basket such that each basket is located on a first respective basket location part, and the second basket assembly further comprises:
a second plurality of basket location parts that are mounted to the second frame and that are configured to support the second plurality of baskets from a bottom of each basket such that each basket is located on a second respective basket location part.

5. The refrigerator according to claim 4, wherein:
the first frame is made of a metal material and comprises:
a first pair of vertical frame parts that are spaced apart from each other and that are parallel to each other; and
three horizontal frame parts that each connect to the first pair of vertical frame parts, and
the second frame is made of the metal material and comprises:
a second pair of vertical frame parts that are spaced apart from each other and that are parallel to each other; and
three additional horizontal frame parts that each connect to the second pair of vertical frame parts.

6. The refrigerator according to claim 4, wherein:
the first locking device comprises:
the first slider that is vertically and slidably mounted at a lower part of the first door and that is configured to selectively engage with a lowermost basket location part of the first plurality of basket location parts and a first elastic member that is configured to push the first slider upward, and
the second locking device comprises:
the second slider that is vertically and slidably mounted at a lower part of the second door and that is configured to selectively engage with a lowermost basket location part of the second plurality of basket location parts and a second elastic member that is configured to push the second slider upward.

7. The refrigerator according to claim 6, wherein:
the first release lever is configured to push the first slider downward, the first release button is configured to push the first slider downward, the second release lever is configured to push the second slider downward, and the second release button is configured to push the second slider downward.

8. The refrigerator according to claim 7, wherein:
the first slider comprises a first catching protrusion that is configured to be selectively inserted into the first catching groove that is located at a bottom of a first basket location part, and the second slider comprises a second catching protrusion that is configured to be selectively inserted into the second catching groove that is located at a bottom of a second basket location part.

9. The refrigerator according to claim 7, wherein:
the first release lever comprises:
a first pivoting shaft part that is pivotably mounted to the first handle groove;
a first lever part that extends from the first pivoting shaft part; and
a first arm part that extends from one end of the first pivoting shaft part and that is configured to push the first slider in response to the pivoting first shaft part pivoting, and
the second release lever comprises:
a second pivoting shaft part that is pivotably mounted to the second handle groove;
a second lever part that extends from the second pivoting shaft part; and
a second arm part that extends from one end of the second pivoting shaft part and that is configured to push the second slider in response to the pivoting second shaft part pivoting.

10. The refrigerator according to claim 1, wherein:
the first basket assembly and the second basket assembly are configured to define a gap based on the first basket assembly being located adjacent to the first inner wall of the storage compartment and the second basket assembly being located adjacent to the second inner wall of the storage compartment,
the first basket assembly is configured to pivot and not interfere with the second basket assembly, and
the second basket assembly is configured to pivot and not interfere with the first basket assembly.

11. The refrigerator according to claim 1, wherein:
the first door comprises a first concave part that is located at a rear of the first door and that is configured to receive a portion of a front of the first basket assembly,
based on the first basket assembly being coupled to a rear of the first door, one side of the first basket assembly is located opposite of an inner side of the first concave part such that the one side the first basket assembly is a first predetermined distance from the inner side of the first concave part,
the second door comprises a second concave part that is located at a rear of the second door and that is configured to receive a portion of a front of the second basket assembly, and
based on the second basket assembly being coupled to a rear of the second door, one side of the second basket assembly is located opposite of an inner side of the second concave part such that the one side the second basket assembly is a second predetermined distance from the inner side of the second concave part.

12. The refrigerator according to claim 11, wherein:
based on the first basket assembly being located in the storage compartment, a bottom of the first basket assembly is located opposite of a bottom of the storage compartment such that the bottom of the first basket assembly is a third predetermined distance from the bottom of the storage compartment, and
based on the second basket assembly being located in the storage compartment, a bottom of the second basket assembly is located opposite of a bottom of the storage compartment such that the bottom of the second basket assembly is a fourth predetermined distance from the bottom of the storage compartment.

13. The refrigerator according to claim 1, further comprising:
a first repulsion member that is located at a rear of the first door and that is configured to separate the first basket assembly from the first door based on the first release device being operated; and a second repulsion member that is located at a rear of the second door and that is configured to separate the second basket assembly from the second door based on the second release device being operated.

14. A refrigerator comprising:

a cabinet;

a storage compartment that is located in the cabinet;

a door that is hinged at an edge of the cabinet and that is configured to open and close the storage compartment;

a basket assembly that is supported by a multi-articulated hinge that is mounted at an inner wall of the storage compartment;

a locking device that is configured to selectively couple the basket assembly to the door, the locking device including a slider mounted to the door and a catching groove in the basket assembly; and a release device that is configured to release the locking device and that comprises:

a release lever that is pivotably mounted at a handle groove that is located at a bottom of the door, the release lever configured to be operated by a user; and a release button that is slidably mounted at and extends from a rear of the door, the release button configured to be operated by a user:

wherein:

operating the release lever releases the slider from the catching groove such that the basket assembly is decoupled from the door; and operating the release button releases the slider from the catching groove such that the basket assembly is decoupled from the door.

15. The refrigerator according to claim 14, wherein the basket assembly comprises:

a frame that is fastened to an end of the multi-articulated hinge; and a plurality of baskets that are located on the frame.

16. The refrigerator according to claim 15, wherein the locking device comprises: the slider that is vertically and slidably mounted at a lower part of the door; and an elastic member that is configured to push the slider upward.

17. The refrigerator according to claim 16, wherein the release device comprises: the release lever that is pivotably mounted in the handle groove that is located at a bottom of the door and that is configured to push the slider downward; and the release button that is slidably mounted to a rear of the door and that is configured to push the slider downward.

18. The refrigerator according to claim 17, wherein the slider comprises a catching protrusion that is configured to be selectively inserted into the catching groove that is located at a bottom of the basket assembly.

19. The refrigerator according to claim 17, wherein:

the release button is located at a rear end of the door with an inclined surface, and the inclined surface is configured to move the slider downward by pushing around an inclined hole that is located at the slider.

20. The refrigerator according to claim 17, wherein the release lever comprises:

a pivoting shaft part that is pivotably mounted to the handle groove, a lever part that extends from the pivoting shaft part, and an arm part that extends from one end of the pivoting shaft part and that is configured to push the slider while the pivoting shaft part pivots.

21. The refrigerator according to claim 20, wherein the lever part is located in the handle groove and adjacent to a pivoting shaft of the door.

22. The refrigerator according to claim 14, wherein a moving track of a front of the basket assembly is configured to pivot while being supported by the multi-articulated hinge and coincide with a moving track of a rear of the door.

23. The refrigerator according to claim 14, wherein the door is concave and configured to receive a portion of a front of the basket assembly based on the door being coupled to the basket assembly.

24. The refrigerator according to claim 14, further comprising a repulsion member that is located at a rear of the door and that is configured to separate the basket assembly from the door based on the release device being operated.

25. The refrigerator according to claim 14, wherein a width of the basket assembly is less than a width of an opening of a front of the storage compartment.

26. A refrigerator comprising:

a cabinet that includes a storage compartment that defines an opening;

a door that is mounted to the cabinet by (i) a first hinge that is mounted at an upper part of the cabinet and (ii) a second hinge that is mounted at a lower part of the cabinet and that is configured to open and close the storage compartment;

a door storage space part that includes an additional storage space that is defined by a step surface that is depressed at an edge of an inner side of the door;

a third hinge that is mounted at an upper part of an inner wall of the storage compartment; a fourth hinge that is mounted at a lower part of the inner wall of the storage compartment;

a basket support frame that is coupled to the third hinge and the fourth hinge and that is configured to rotate between the opening and a maximum opening angle of the door;

a pair of vertical frame parts that each define a portion of the basket support frame, that are each configured such that (i) at least a portion of each of the vertical frame parts is spaced apart from a respective inner wall of the storage compartment based on each of the vertical frame parts being located at the opening and (ii) at least a portion of each of the vertical frame parts is spaced apart from the respective inner side of the door based on each of the vertical frame parts being coupled to the respective inner side of the door, and that each has a handle part that is configured to rotate the respective basket support frame;

a pair of horizontal frame parts that each include a portion of the basket support frame and that are each connected to one of the vertical frame parts;

a basket that includes a bottom that is mounted to one of the horizontal frame parts, a front portion that is located in the door storage space part based on the basket being coupled to the inner side of the door, and a rear portion that is located outside the door storage space part based on the basket being coupled to the inner side of the door;

a locking device that is configured to selectively couple the basket assembly and the door, the locking device including a slider mounted to the door and a catching groove comprised in the basket;

a release device that is configured to release the locking device to separate the basket support frame and the door by releasing the locking device and that comprises:

a release lever that is pivotably mounted at a handle groove that is located at a bottom of the door, the release lever configured to be operated by a user; and a release button that is slidably mounted at and extends from a rear of the door, the release button configured to be operated by a user:

wherein:

operating the release lever releases the slider from the catching groove such that the basket is decoupled from the door; and operating the release button releases the slider from the catching groove such that the basket is decoupled from the door.

27. The refrigerator according to claim 26, wherein the release device is configured to release the locking device and is accessible from an outside and an inside of the door.

28. The refrigerator according to claim 27, wherein:

the release lever is operable from the outside of the door based on the door being closed;

and the release button is operable from the inside of the door based on the door being open.

* * * * *